US010448764B2

(12) United States Patent
Aydemir

(10) Patent No.: US 10,448,764 B2
(45) Date of Patent: Oct. 22, 2019

(54) PILLOW ADJUSTING DEVICE AND METHOD OF USE

(71) Applicant: Bedir Aydemir, Enfield (GB)

(72) Inventor: Bedir Aydemir, Enfield (GB)

(73) Assignee: Bedir Aydemir, Enfield (GB)

( * ) Notice: Subject to any disclaimer, the term of this patent is extended or adjusted under 35 U.S.C. 154(b) by 603 days.

(21) Appl. No.: 14/766,643

(22) PCT Filed: Feb. 10, 2014

(86) PCT No.: PCT/GB2014/050383
§ 371 (c)(1),
(2) Date: Aug. 7, 2015

(87) PCT Pub. No.: WO2014/122483
PCT Pub. Date: Aug. 14, 2014

(65) Prior Publication Data

US 2015/0366381 A1 Dec. 24, 2015

(30) Foreign Application Priority Data

Feb. 10, 2013 (GB) ..... 1302317.1

(51) Int. Cl.
*A47G 9/10* (2006.01)
*A47C 7/38* (2006.01)

(52) U.S. Cl.
CPC ..... *A47G 9/10* (2013.01); *A47G 9/109* (2013.01); *A47G 9/1009* (2013.01); *A47C 7/383* (2013.01); *A47G 2009/1018* (2013.01)

(58) Field of Classification Search
CPC ..... A47G 9/10; A47G 9/1009; A47G 2009/1018; A47G 9/1081; A47G 9/109; A47G 9/0253; A47G 9/0238; A47C 7/383; A47C 7/38
USPC ..... 5/643, 636, 639, 640, 645, 490
See application file for complete search history.

(56) References Cited

U.S. PATENT DOCUMENTS 2,952,856 A 8/1956 Ruff
3,243,828 A * 4/1966 McCarty ..... A47G 9/10 5/405
4,193,150 A * 3/1980 Vineberg ..... A47C 20/027 297/DIG. 1

(Continued)

FOREIGN PATENT DOCUMENTS

CN 201337224 Y 11/2009
CN 201422680 Y 3/2010
JP 2002291599 A 10/2002

*Primary Examiner* — Robert G Santos
(74) *Attorney, Agent, or Firm* — Michele M. Wales; Inhouse Patent Counsel, LLC

(57) ABSTRACT

A method of promoting comfort when sleeping or resting by placing a pillow adjusting device (D) underneath a subjects conventional pillow (3). The device (D) creates multi-level head support to assist rest or sleep and reduce next strain when sleeping or resting. The device (D) preferably comprises two pads (1) at a higher level, connected by a central section (2) of a lower level. The user's pillow (3) is placed on top of the device, thus raising the sides of the pillow (3) to a higher level which is more suitable to the user when the user is lying on their side. The central portion (2) is at a more suitable height for when the user is lying on their back. The central portion (2) may contain an additional section (4) to provide neck support when lying on ones back.

18 Claims, 5 Drawing Sheets

(56) References Cited

U.S. PATENT DOCUMENTS 4,494,261 A * 1/1985 Morrow ..... A47G 9/109 5/636
D306,245 S * 2/1990 Akhtarekhavari ..... 297/391
D308,455 S * 6/1990 Jenney ..... 5/636
5,016,303 A 5/1991 Tanaka et al.
5,168,590 A 12/1992 O'Sullivan
5,214,814 A * 6/1993 Eremita ..... A47G 9/109 5/632
5,457,832 A 10/1995 Tatum
5,537,699 A * 7/1996 Bonaddio ..... A47C 27/063 5/717
6,230,348 B1 * 5/2001 Patrikakis ..... A47C 7/383 5/636
6,513,179 B1 2/2003 Pan
6,671,906 B1 * 1/2004 Milligan ..... A47G 9/10 5/636
6,981,288 B1 * 1/2006 Hu ..... A47G 9/10 5/636
7,254,852 B2 * 8/2007 Martin ..... A47G 9/10 5/636
7,975,336 B1 7/2011 Perry et al.
8,245,339 B2 * 8/2012 Murray ..... A47G 9/10 5/657
D711,669 S * 8/2014 Holder ..... D6/601
9,434,283 B2 * 9/2016 Spalter ..... B60N 2/882
2004/0006822 A1 * 1/2004 Milligan ..... A47G 9/10 5/636
2005/0005363 A1 * 1/2005 Giori ..... A47C 27/081 5/709
2005/0102756 A1 * 5/2005 Martin ..... A47G 9/10 5/636
2005/0278852 A1 * 12/2005 Wahrmund ..... A47C 27/05 5/636
2008/0235877 A1 * 10/2008 Murray ..... A47G 9/10 5/640
2011/0083277 A1 * 4/2011 Henson ..... A47C 27/144 5/655.9
2011/0252572 A1 * 10/2011 Morrison ..... A47C 27/144 5/740
2015/0366381 A1 * 12/2015 Aydemir ..... A47G 9/109 5/643
2016/0114708 A1 * 4/2016 Spalter ..... B60N 2/882 297/397

* cited by examiner

PILLOW ADJUSTING DEVICE AND METHOD OF USE

TECHNICAL FIELD OF THE INVENTION

The present invention relates to a pillow adjusting device and more specifically to a pillow adjusting device that is placed beneath the pillow in order to adjust the configuration of the users own pillow in order to provide ergonomic support.

INTRODUCTION AND BACKGROUND ART

Most people when sleeping or resting will, periodically, switch position between lying on their back and lying on either side. Due to the shape of the human body, an ideal support for use when sleeping or resting on one's side will be at a different height to a support for use when sleeping on one's back.

More specifically, it is important to maintain the head in a neutral position (as shown in FIGS. 15 and 17) regardless of whether the subject is lying on his/her back or side. A neutral position when lying on one's back would be described as the head not being pushed too far forward or allowed to tilt too far back. A neutral position when lying on one's right hand side would be described as the head not being raised too far up, so tilted to the left, or allowed to drop down, so tilted the right. When a subject is lying on their left hand side a neutral position would be with the head not pushed too far up, so being tilted to the right, or being allowed to drop down, so being tilted to the left.

Any deviation from this neutral position can result in neck strain, particularly if the deviation is prolonged, by causing over-extension or contraction of the ligaments in the neck, and corresponding contraction or stretching of the surrounding neck muscles. Deviation may also place undue pressure on the intervertebral discs. The result of the strain can be discomfort whilst sleeping or resting, and also continuing discomfort in the neck area the following day.

Typical pillows only allow one height of support. This is the same regardless of sleeping position. If the pillow is too high (as shown in FIG. 16) then whilst a person is lying on their back, the head will be too elevated, resulting in neck strain through over stretching of the neck ligaments at the rear of the neck. Whilst lying on one's side, if the pillow is too low (as shown in FIG. 18) the head will pull the neck down resulting in neck strain through over stretching of neck ligaments on the upper side of the neck and compression of the facet joints. As such, conventional pillows offer a 'compromise' and often do not offer the correct height of support for either sleeping position.

Ergonomic pillows have been on the market for some years. Although these can improve the situation somewhat, they have several drawbacks, not least of which is the expense of such pillows.

CN201263564 (HEQIAN) is an example of such an ergonomic pillow. This document discloses a pillow structure having regulating pads placed under three pillows: one main pillow and two auxiliary pillows on either side. The regulating pads regulate the height of the pillows. In some embodiments shown, the main pillow is lower than the two auxiliary pillows. In this embodiment there is one regulating pad placed under each of the pillows. In another embodiment shown, the main pillow is the same height as the auxiliary pillows. In that embodiment, multiple regulating pads are placed underneath the main pillow. A pillow sleeve surrounds the pillow structure. The modular nature of this pillow structure means that it is likely to be expensive. Being a pillow in itself, the disclosed structure is an alternative to a conventional pillow. Having to replace their conventional pillow is an inconvenience to the user.

CN201743375 (YONGJIU) also discloses an ergonomic pillow. The disclosed pillow is modular, being formed of a plurality of inner pillow blocks connected together. The modularity allows the pillow to form different heights. Because each inner block is 2-4 cm in height, the height of the pillow at any one point will be a multiple of 2-4. In none embodiment shown, the pillow is shaped so that it is lower in the middle and higher at the sides. As with the pillow of CN201263564, this pillow is likely to be expensive and inconvenient for the user.

Thus, there is a need for a method of reducing the risk of neck strain and promoting comfortable sleep or rest, regardless of whether the subject is lying on their back or side, that is inexpensive and convenient for the user. The present invention, in its various embodiments, some of which are described here, aims to meet this need.

BRIEF DESCRIPTION OF THE INVENTION

Accordingly, the present invention provides a method of promoting comfort when sleeping or resting comprising:

a) providing a pillow adjusting device, the device having substantially the same length and width as a conventional pillow and comprising at least two adjoining sections along its length, wherein one section includes a pad having a height that is at least 10 mm higher than one other section when the one section and the other section are both in an uncompressed state, and the other section has a height of less than 60 mm in an uncompressed state; and b) placing the device underneath a pillow, thereby adjusting the height of the pillow in at least one position along its length relative to another position along its length.

A pillow adjusting device for use in the invented method is also provided. The device having substantially the same length and width as a conventional pillow and comprising three sections along its length, wherein the two exterior sections each include a pad, and the height of the centre section is less than 60 mm, wherein at least one exterior section includes a pad having a height of at least 10 mm greater than the centre section when the same exterior section and the centre section are both in an uncompressed state, and each section has a length that is approximately a third of the length of the device. The invention further provides for a kit comprising a pillow adjusting device, separate interchangeable pads and/or a removably attachable fourth section.

BRIEF DESCRIPTION OF THE FIGURES

Embodiments of the present invention will now be described, by way of example only, with reference to the following figures, in which.

DETAILED DESCRIPTION OF THE INVENTION

Figure 1:
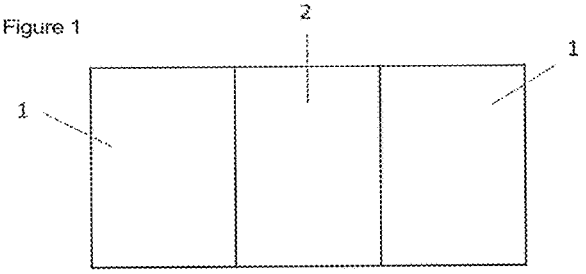
FIG. 1 shows a birds-eye view of a first embodiment of a product of the invention.
Figure 2:
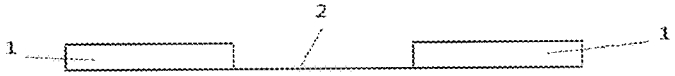
FIG. 2 shows a front view of a first embodiment of a product of the invention.
Figure 3:
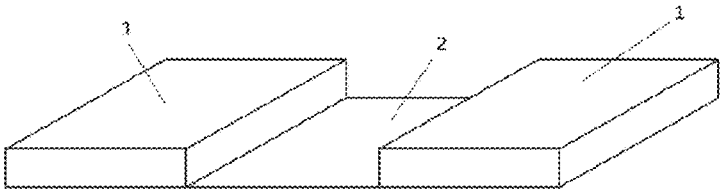
FIG. 3 shows a front-isometric view of a first embodiment of a product of the invention.

In a first, and preferred, embodiment of the product of the invention, shown in FIGS. 1-5, a device (D) comprises three sections, wherein two of the sections include a 3-dimensional rectangular pad (1). In preferred embodiments, only a single pad is included in each of these two sections. The height of each section is dictated by the broadness of a subject's shoulder (roughly the distance between the base of the neck and the side of the shoulder), and as such will depend on the subject, particularly their age and sex. More specifically, it is limited by the natural range in heights that occur between a person's back and the back of their head when lying on their back, and also by the distance between their shoulder and the side of their head when lying on their side. The ratios between these two specifically dictate the ratio of the height of the sections. The height of each pad (1) will depend on the requirements of the subject, but can be between 10 mm and 100 mm or even higher, up to 300 mm, but preferably between 10 mm and 200 mm, or between 50 mm and 200 mm, or between 100 mm and 200 mm, or between 150 mm and 200 mm. The height of the sections containing pads (1) are at least 10 mm higher than the other section of the device when all the sections are in an uncompressed state.

Each pad (1) is approximately a third of the size of a single conventional pillow (i.e. a common sleeping pillow or bed pillow) (3), measuring approximately 230 by 400 mm, up to 250 mm by 500 mm. Preferably, each pad is approximately a third of the length of a single conventional pillow and has the same width as a conventional pillow. A conventional pillow may be approximately 50 cm×75 cm in size.

Preferably the device (D) comprises the two pads (1) at or near its ends, with a centre section (2) separating the pads (1). In general the device resembles a trough, with the centre section (2) forming the base of the trough and the pads (1) forming the sides of the trough.

Each pad (1) is preferably encased in a material case. The case will preferably be made of material in keeping with traditional sleeping pillows, such as a cotton polyester mix or similar. The two cases are joined together by material, which also serves as the centre section of the device (2). In some embodiments, the centre section (2) may extend across the bottom of entire device, so making up the centre section (2) and the bottom section of the pad covers. The centre section (2) is preferably made of the same material as the pad cases and could be stitched or glued to the adjoining pads (1). The centre section (2) has a height which is less than 60 mm.

In preferred embodiments the centre section (2) does not provide support itself as it is not padded. The centre section (2) is, in this embodiment, of minimal height, preferably between 1 mm and 10 mm, or between 1 mm and 5 mm, or less than 1 mm. depending on the material used and is approximately a third of the size of a conventional pillow (3), measuring approximately 230 mm by 400 mm, up to 250 mm by 500 mm.

The pads (1) are preferably made from shaped or moulded foam of a hardness that is substantially the same as that of a standard mattress. In some embodiments the whole device (D) is made from a single continuous piece of shaped or moulded foam. In particular, the pads may be made substantially or wholly from polyurethane foam. The firmness of polyurethane foam is measured by a physical property called Indentation Force Deflection (IFD). An explanation of the IFD scale, and ratings for certain product types can be found on the Polyurethane Foam Association website (www.pfa.org). A soft mattress has an IFD rating (@ 25% Deflection use (pounds/50 insq. On 20"×20"×4") of 24-30. A standard mattress has an IFD rating (@ 25% Deflection use (pounds/50 insq. On 20"×20"×4") of 30-36, and a firm mattress has an IFD rating (@ 25% Deflection use (pounds/50 insq. On 20"×20"×4") of 36-45.

Alternatively, each pad (1) might be made from tightly packed 'stuffing' material such as hollow polyester fibre to achieve the hardness of a standard mattress.

Figure 7:
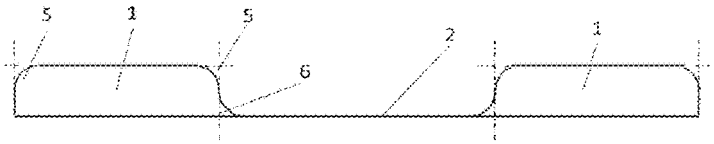
FIG. 7 shows a front view of an embodiment of a product of the invention having rounded edges.
Figure 8:
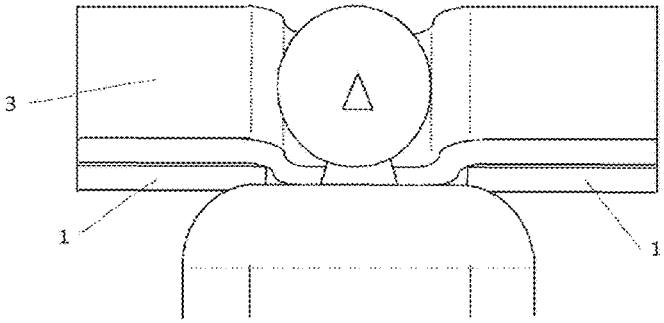
FIG. 8 shows a top-isometric view of a first embodiment of a product of the invention placed underneath a pillow and being used by a subject lying on their back.
Figure 9:
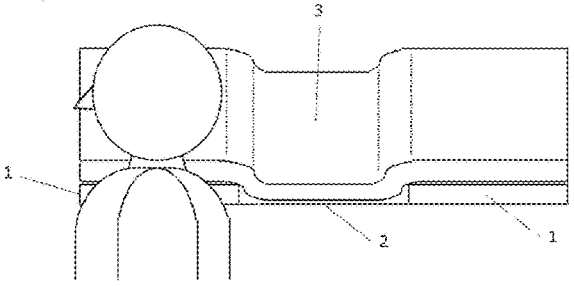
FIG. 9 shows a top-isometric view of a first embodiment of the product of the invention placed underneath a pillow and being used by a subject lying on their side.
Figure 10:
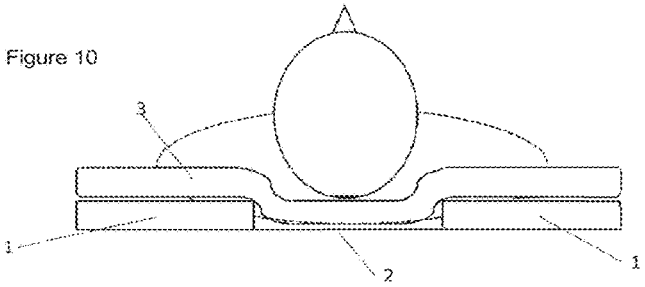
FIG. 10 shows a rear view of an embodiment of a product of the invention placed underneath a pillow and being used by a subject lying on their back.
Figure 11:
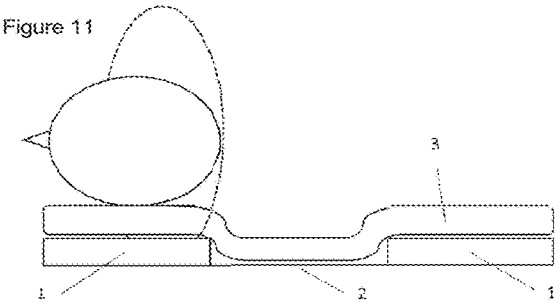
FIG. 11 shows a rear view of an embodiment of a product of the invention placed underneath a pillow and being used by a subject lying on their side.

The top of the pads (1) may be shaped or contoured to provide more comfortable support when lying on one's sides, for example, they may have rounded edges (5) as shown in FIG. 7. The bottom edge of each pad (1) that joins to the centre section (2) may be tapered (6) outwards to provide a more seamless transition between the pads (1) and the centre section (2), as shown in FIG. 7. The pads (1) are preferably, although need not be, of the same height as each other, The pillow adjustment device of the invention may be used in the method of the invention for promoting comfort when sleeping or resting. The device is used, in conjunction with a pillow, to provide at least two levels of support. By allowing for a two tier height of support, optimal support can be maintained no matter the sleeping or resting position, so potentially reducing neck muscle strain. Preferably, the device (D) is used in conjunction with a single (conventional) pillow placed on top of the device, such that the pillow covers substantially the whole of the top surface of the device.

Figure 4:
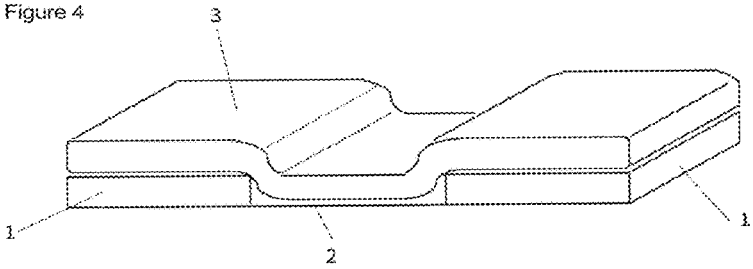
FIG. 4 shows a front-isometric view of a first embodiment of the product of the invention placed underneath a pillow.
Figure 5:
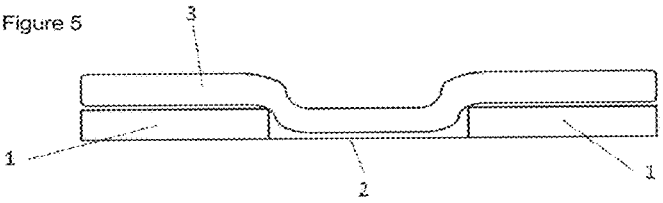
FIG. 5 shows a front view of a first embodiment of the product of the invention placed underneath a pillow.

Use of the first embodiment of the product of the invention in the invented method will deform the pillow resulting in a raised level at either end of the pillow, with each end roughly a third the width of a standard pillow, as shown in FIG. 4. This creates two levels; a lower height in the middle, which is used when lying on one's back, and a higher height at either side of the centre, to provide higher support when lying on one's side. This will offer the subject greater support when lying on either side.

In embodiments with a thin centre section (2), having a height of between 1 mm and 10 mm, or between 1 mm and 5 mm, or less than 1 mm, the elevation of the pillow above the centre section (3) will be minimal. The lower height in the middle will be substantially the original height of the subject's pillow. This may be advantageous as it allows maximal discrepancy in height between the pillow (3) above the centre section (2) and the exterior sections containing the pads (1), with minimal material, reducing cost.

In all embodiments, the centre or middle section (2) is always lower than the end sections, as this provides most comfort for the patient. A device (D) having a centre section (2) that is higher than the end sections does not form part of the invention.

Preferably the height of the device (D) can be adjusted by varying the height of the pads (2), in order to provide the correct level of support when the user is lying on their side. In preferred embodiments a plurality of interchangeable pads of different heights is provided. Where the device includes a plurality of interchangeable pads an opening is provided in the material casing and/or the material defining the centre section and the pads are interchangeable through said opening(s).

A major advantage over previous attempts to solve the current problem is that embodiments of the invention allow the subject to retain the use of their current pillow. The device of the present invention is not a pillow itself, but is used in conjunction with an existing pillow such that it improves the ergonomic qualities of the existing pillow. The subject may be uncomfortable with disposing of their current pillow as it may have been especially selected, for example for its preferable stuffing material or level of firmness. Other, already available, solutions to the current problem often require the use of an ergonomic pillow, which may not have the preferable qualities of the user's current pillow. A further benefit is that the subject may already own preferred pillow cases which may include patterns or designs which they have specifically chosen for their aesthetic benefits. As the subject's original pillow can be used in conjunction with the present invention, so too can their preferred pillow cases for those pillows. Overall, embodiments of the invention provide more user-friendly solutions. It is also a more cost-effective solution as it does not require the subject to purchase a brand new specially constructed pillow or new pillow cases.

Figure 6:
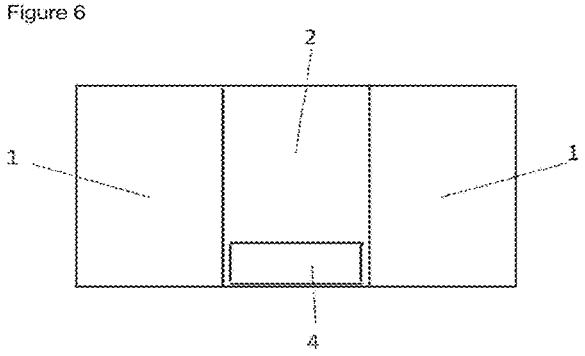
FIG. 6 shows a birds-eye view of a second embodiment of a product of the invention, having a fourth section.
Figure 12:
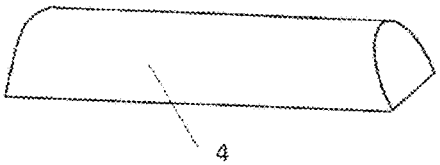
FIG. 12 shows a fourth section of a second embodiment of a product of the invention.
Figure 13:
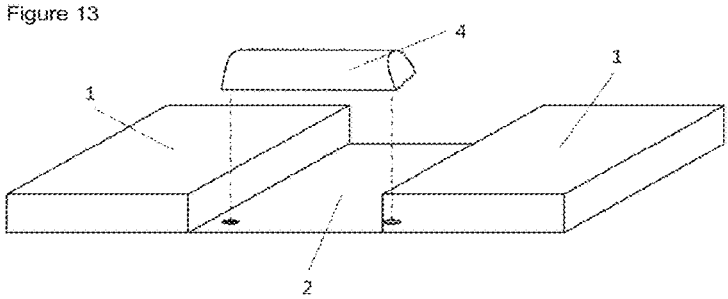
FIG. 13 shows an exploded isometric view of the section of a fourth section according to FIG. 12 being removably attachable to a second embodiment of a product of the invention.
Figure 14:
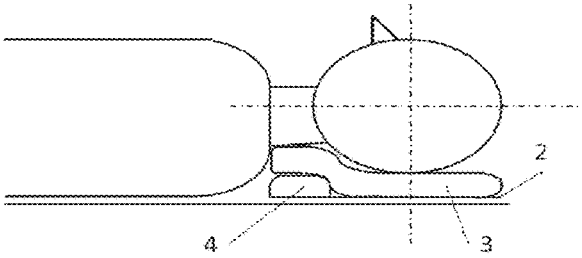
FIG. 14 shows a side view (with only the central section, and fourth section—no pads) of a second embodiment of a product of the invention placed underneath a pillow and being used by a subject lying on their back.
Figure 15:
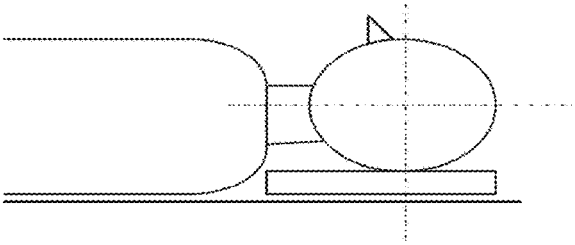
FIG. 15 shows the correct height of a support when the subject is lying on their back.
Figure 16:
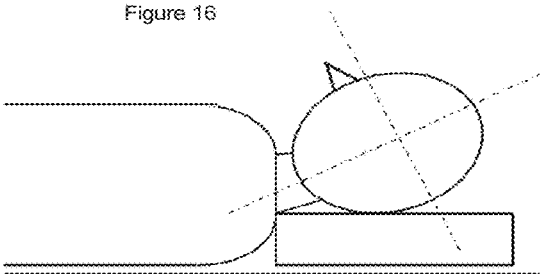
FIG. 16 shows an incorrect height of a support when the subject is lying on their back.
Figure 17:
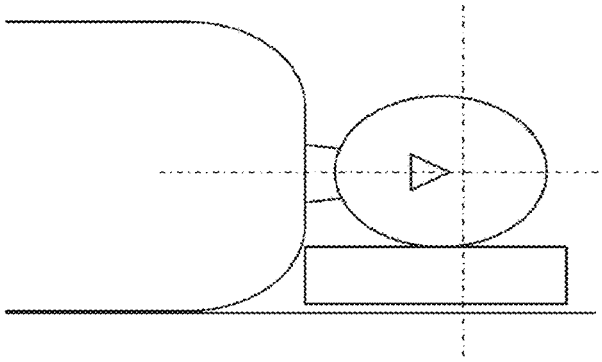
FIG. 17 shows the correct height of a support when the subject is lying on their side.
Figure 18:
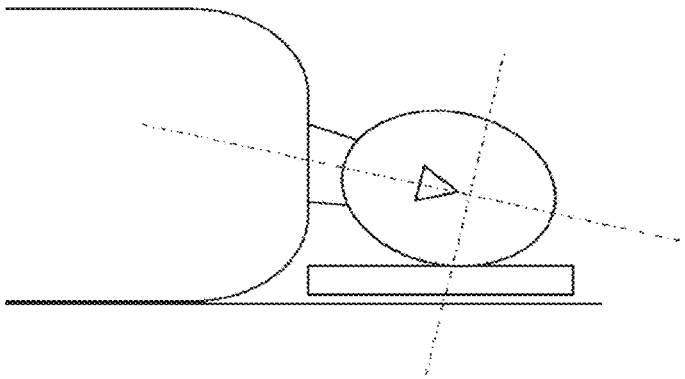
FIG. 18 shows an incorrect height of a support when the subject is lying on their side.

A second embodiment of the product of the invention comprises the first embodiment described above and an additional fourth section (4), as shown in FIGS. 6, 12 and 13, located at or near the front of the central section (2). This fourth section (4) provides support for the subject's neck when they are lying on their back and utilising the central section (2) of the pillow. This is demonstrated by FIG. 14. This section may cover the full width of the middle section (approximately 230 mm, up to 250 mm) or only a part of the width. Its length is preferably approximately that of the distance between the base of the back of the neck and back of the head of the subject. (Approximately 5 mm to 15mm). Its height will be approximately 10 mm to 50 mm depending on the subject's requirements.

The fourth section (4) may be formed by having an additional pad encased within the material of the centre section (2). Alternatively, this section may be removably attachable to the centre section (2) by an attachment means, such as poppers or Velcro®. If this section (4) is removably attachable, it is preferably formed from the same material as the pads (2).

A third embodiment of the product of the invention has only one pad (1) on one side of the device (D) and no pad (1) on the other side (i.e. one of the pads (1) is removed). The remaining pad (1) would therefore form one side of the device (D), with the centre section (2) thus forming the other side of the device (D). In general, this embodiment would resemble a single step, rather than a trough. This embodiment would still provide two levels of support, and so can increase comfort for back or side sleeping. Depending on which side the user wished to lie, the device (D) would need to be rotated accordingly. In this embodiment, each section is approximately half of the size of a conventional pillow (3).

Any embodiment may further comprise an attachment means, by which device (D) may be secured to the user's pillow, so that the device (D) is substantially directly under the pillow, for instance by the top surface of the device (D) being secured to the underside of the user's pillow. Any suitable attachment method may be used for this, for instance straps, clasps or patches which can be sewn by a user to the pillow, or a case which surrounds the device and the user's pillow.

Any embodiment may also further comprise a stiffening means which functions to prevent the centre section (2) from folding, thus maintaining the preferred spacing between the pads (1). An example of a suitable stiffening means would be rigid metal wiring passing along the length of the underside of the device (D).

Any embodiment of the product of the invention may be used in the above-described method for promoting comfort when sleeping or resting.

The claimed method and device differ significantly from prior art pillows, including the prior art ergonomic pillows mentioned in the "Introduction" section. Most importantly, the claimed device is not a pillow itself, it is a pillow adjusting device that is designed for use in combination with a conventional pillow. The features of the claimed device make it particularly suitable for this purpose, in particular the preferred height ranges of the sections, the lower centre section, and the unsupportive centre section of some embodiments. The method represents the novel concept of placing a conventional pillow on top of a pillow adjusting device to alter pillow height, rather than providing a pillow with adjusted or adjustable heights. This has the significant advantages described above.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A method of improving the ergonomic qualities of a conventional bed pillow comprising:

a) providing a device, the device having substantially the same length and width as the conventional bed pillow, the device comprising adjoining sections along its length, wherein one section of the adjoining sections has a pad with a height that is at least 10 mm higher than the other section of the adjoining sections when the adjoining sections are both in an uncompressed state, and wherein the other section has a height of between 1 mm and 10 mm in an uncompressed state, and wherein the pad has the hardness of a standard mattress, a standard mattress having an Indentation Force Deflection (IFD) rating at 25% deflection of between 30 and 36 pounds per 50 square inch (133N and 160N) on 20"×20"×4" (50.8 cm×50.8 cm×10.16 cm); and b) placing the device underneath the conventional bed pillow, thereby adjusting the height of the pillow in at least one position along its length relative to another position along its length when in use to provide at least two levels of support.

2. The method of claim 1, wherein the pad is made from polyurethane foam.

3. The method of claim 1, wherein the pad is made of hollow polyester fibre.

4. The method of claim 1, wherein the adjoining sections along the length of the device further comprises three sections, one of the three sections comprising a centre section and two of the three sections comprising exterior sections, and wherein the exterior sections each have a pad, and wherein the height of the centre section is between 1 mm and 10 mm.

5. The method of claim 4, wherein each of the pads is encased by a first fabric material case, and wherein the centre section is formed from a second fabric material, and wherein the first fabric material cases are joined by fixing each of the first fabric material cases along one edge to a length of the second fabric material.

6. The method of claim 5, wherein an opening is provided in the first fabric material case, and wherein each of the pads is interchangeable through that opening with other pads of different heights.

7. The method of claim 5, wherein an opening is provided in the second fabric material and each of the pads is interchangeable through that opening with pads of different heights.

8. The method of claim 7, wherein the lengths of the centre section and each pad is approximately a third the length of the conventional pillow.

9. The method of claim 8, the device further comprising a fourth section located within the centre section, wherein the height of the fourth section is greater than 10 mm but less than the height of the pads.

10. The method of claim 9, wherein the fourth section is formed by having an additional pad encased within the second fabric material.

11. The method of claim 10, wherein the fourth section is removably attachable to the centre section and is formed of the same material as the pads.

12. The method of claim 11, wherein the length of the fourth section is the same as the length of the centre section.

13. A device, for use in combination with a conventional bed pillow, the device having substantially the same length and width as the conventional pillow, being approximately 50 cm×75 cm in size, the device comprising: at least two adjoining sections along its length, wherein a first section comprises a pad having a height that is at least 10 mm higher than the second section when the first section and the second section are both in an uncompressed state, and the second section has a height of between 1 mm and 10 mm in an uncompressed state, and wherein the pad has the hardness of a standard mattress, a standard mattress having an IFD rating at 25% deflection of between 30 and 36 pounds per 50 square inch (133N and 160N) on 20"×20"×4" (50.8 cm×50.8 cm×10.16 cm).

14. The device of claim 13, further comprising a third adjoining section along its length, wherein the second section comprises a centre section and the first section and the third section comprise exterior sections, and wherein both the exterior sections comprise a pad, and wherein the height of the second section is between 1 mm and 10 mm, and at least one of the pads in the exterior sections has a height of at least 10 mm greater than the height of the centre section when the same exterior section and the centre section are both in an uncompressed state, and each section has a length that is approximately a third of the length of the device.

15. The device of claim 14, further comprising an attachment mechanism permitting the device to be secured to the conventional pillow so that the device is substantially directly underneath the pillow.

16. The device of claim 15, further comprising a stiffening element in the centre section that prevents the centre section from folding.

17. The device of claim 14, wherein the device further comprises a fourth section located within the centre section, and wherein the height of the fourth section is greater than 10 mm but less than the height of the pads.

18. The device of claim 17, wherein the length of the fourth section is the same as the length of the centre section.

* * * * *